US006923013B2

(12) United States Patent
Chiang et al.

(10) Patent No.: US 6,923,013 B2
(45) Date of Patent: Aug. 2, 2005

(54) EVAPORATOR FOR MEDIUM TEMPERATURE REFRIGERATED MERCHANDISER

(75) Inventors: Robert Hong Leung Chiang, Shanghai (CN); Eugene Duane Daddis, Jr., Manlius, NY (US); Kwok Kwong Fung, Granger, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/743,394

(22) Filed: Dec. 22, 2003

(65) Prior Publication Data

US 2004/0168456 A1 Sep. 2, 2004

Related U.S. Application Data

(63) Continuation-in-part of application No. 09/849,209, filed on May 4, 2001, now Pat. No. 6,679,080.

(51) Int. Cl.[7] ..... A47F 3/04
(52) U.S. Cl. ..... 62/246; 62/255; 62/256
(58) Field of Search ..... 62/246, 255, 256, 62/440, 515; 165/150, 151, 152, 153

(56) References Cited

U.S. PATENT DOCUMENTS

| | | | |
|---|---|---|---|
| 2,200,502 A | 5/1940 | Johnson | |
| 2,384,313 A | 9/1945 | Kohler | |
| 2,715,321 A | 8/1955 | Burger | |
| 2,912,834 A | 11/1959 | Mann | |
| 2,986,901 A | 6/1961 | Hubacker | |
| 2,991,048 A | 7/1961 | Rabin | |
| 3,012,760 A | 12/1961 | McGrath | |
| 3,267,692 A | 8/1966 | Pfeiffer et al. | |
| 3,577,744 A | 5/1971 | Mercer | |
| 3,681,896 A | 8/1972 | Velkoff | |

(Continued)

FOREIGN PATENT DOCUMENTS

| | | | |
|---|---|---|---|
| EP | 1316119 A | | 10/1969 |
| JP | 07189684 A | | 7/1995 |
| JP | 08-303933 | | 11/1996 |
| JP | 10-148441 | | 6/1998 |
| JP | 410185413 | * | 7/1998 |

*Primary Examiner*—Harry B. Tanner
*Assistant Examiner*—Mohammad M. Ali

(57) ABSTRACT

A refrigerated merchandiser (100) includes an upright, open-front, insulated cabinet (110) defining a product display area (125) connected in airflow communication with a compartment (120) via an air circulation circuit (122, 114, 116). The flow of refrigerant through the coils (46) of evaporator (40) disposed in the compartment (120) to cool the airflow from the product display area of the refrigerated merchandiser.

13 Claims, 7 Drawing Sheets

U.S. PATENT DOCUMENTS 3,745,786 A 7/1973 Laughlin et al.
3,800,551 A 4/1974 Weibel, Jr. et al.
3,800,747 A * 4/1974 Hapgood ..... 122/235.11
3,834,176 A 9/1974 Clarke
4,272,969 A 6/1981 Schwitzgebel
4,434,843 A 3/1984 Alford
4,545,428 A 10/1985 Onishi et al.
4,569,390 A 2/1986 Knowlton et al.
4,644,758 A 2/1987 Maehara et al.
4,658,602 A 4/1987 Giberson et al.
4,776,178 A 10/1988 Buchser
5,157,941 A * 10/1992 Cur et al. ..... 62/441
5,179,845 A 1/1993 Sasaki et al.
5,228,197 A * 7/1993 Cox et al. ..... 29/890.035
5,502,979 A * 4/1996 Renard ..... 62/256
5,664,427 A * 9/1997 Rockenfeller et al. ..... 62/112
5,682,944 A 11/1997 Yamamoto et al.
5,743,098 A 4/1998 Behr
5,755,108 A 5/1998 Dickey et al.
5,799,728 A 9/1998 Blume
5,832,995 A 11/1998 Chiang et al.
5,974,818 A 11/1999 Topper et al.
6,076,368 A 6/2000 Noble
6,102,107 A 8/2000 Dunne
6,145,327 A 11/2000 Navarro
6,167,619 B1 1/2001 Beagle
6,237,350 B1 5/2001 Hertel
6,308,527 B1 10/2001 Kuroyanagi et al.
6,354,367 B1 * 3/2002 Gong et al. ..... 165/125
2001/0017203 A1 * 8/2001 Uemura et al. ..... 165/201

* cited by examiner

EVAPORATOR FOR MEDIUM TEMPERATURE REFRIGERATED MERCHANDISER

This application is a continuation-in-part of commonly assigned application Ser. No. 09/849,209, filed 4 May 2001, now U.S. Pat. No. 6,679,080, for Medium Temperature Refrigerated Merchandise.

TECHNICAL FIELD

The present invention relates generally to refrigerated merchandiser systems and, more particularly, to a refrigerated, medium temperature, merchandiser system for displaying food and/or beverage products.

BACKGROUND OF THE INVENTION

In conventional practice, supermarkets and convenient stores are equipped with display cases, which may be open or provided with doors, for presenting fresh food or beverages to customers, while maintaining the fresh food and beverages in a refrigerated environment. Typically, cold, moisture-bearing air is provided to the product display zone of each display case by passing air over the heat exchange surface of an evaporator coil disposed within the display case in a region separate from the product display zone so that the evaporator is out of customer view. A suitable refrigerant, such as for example R-404A refrigerant, is passed through the heat exchange tubes of the evaporator coil. As the refrigerant evaporates within the evaporator coil, heat is absorbed from the air passing over the evaporator so as to lower the temperature of the air.

A refrigeration system is installed in the supermarket and convenient store to provide refrigerant at the proper condition to the evaporator coils of the display cases within the facility. All refrigeration systems include at least the following components: a compressor, a condenser, at least one evaporator associated with a display case, a thermostatic expansion valve, and appropriate refrigerant lines connecting these devices in a closed circulation circuit. The thermostatic expansion valve is disposed in the refrigerant line upstream with respect to refrigerant flow of the inlet to the evaporator for expanding liquid refrigerant. The expansion valve functions to meter and expand the liquid refrigerant to a desired lower pressure, selected for the particular refrigerant, prior to entering the evaporator. As a result of this expansion, the temperature of the liquid refrigerant also drops significantly. The low pressure, low temperature liquid evaporates as it absorbs heat in passing through the evaporator tubes from the air passing over the surface of the evaporator. Typically, supermarket and grocery store refrigeration systems include multiple evaporators disposed in multiple display cases, an assembly of a plurality of compressors, termed a compressor rack, and one or more condensers.

Additionally, in certain refrigeration systems, an evaporator pressure regulator (EPR) valve is disposed in the refrigerant line at the outlet of the evaporator. The EPR valve functions to maintain the pressure within the evaporator above a predetermined pressure set point for the particular refrigerant being used. In refrigeration systems used to chill water, it is known to set the EPR valve so as to maintain the refrigerant within the evaporator above the freezing point of water. For example, in a water chilling refrigeration system using R-12 as refrigerant, the EPR valve may be set at a pressure set point of 32 psig (pounds per square inch, gage) which equates to a refrigerant temperature of 34 degrees F.

In conventional practice, evaporators in refrigerated food display systems generally operate with refrigerant temperatures below the frost point of water. Thus, frost will form on the evaporators during operation as moisture in the cooling air passing over the evaporator surface comes in contact with the evaporator surface. In medium-temperature refrigeration display cases, such as those commonly used for displaying produce, milk and other dairy products, or beverages in general, the refrigerated product must be maintained at a temperature typically in the range of 32 to 41 degrees F. depending upon the particular refrigerated product. In medium temperature produce display cases for example, conventional practice in the field of commercial refrigeration has been to pass the circulating cooling air over the tubes of an evaporator in which refrigerant passing through the tubes boils at about 21 degrees F. to maintain the cooling air temperature at about 31 or 32 degrees F. In medium temperature dairy product display cases for example, conventional practice in the commercial refrigeration field has been to pass the circulating cooling air over the tubes of an evaporator in which refrigerant passing through the tubes boils at about 21 degrees F. to maintain the cooling air temperature at about 28 or 29 degrees F. At these refrigerant temperatures, the outside surface of the tube wall will be at a temperature below the frost point. As frost builds up on the evaporator surface, the performance of the evaporator deteriorates and the free flow of air through the evaporator becomes restricted and in extreme cases halted.

Fin and tube heat exchanger coils of the type having simple flat fins mounted on refrigerant tubes that are commonly used as evaporators in the commercial refrigeration industry characteristically have a low fin density, typically having from 2 to 4 fins per inch. Customarily, in medium temperature display cases, an evaporator and a plurality of axial flow fans are provided in a forced air arrangement for supplying refrigerated air to the product area of the display case. Most commonly, the fans are disposed upstream with respect to air flow, that is in a forced draft mode, of the evaporator in a compartment beneath the product display area, with there being one fan per four-foot length of merchandiser. That is, in a four-foot long merchandiser, there would typically be one fan, in an eight-foot long merchandiser there would be two fans, and in a twelve-foot long merchandiser there would be three fans.

In operation, the fans force the air through the evaporators, passing over the tubes of the fin and tube exchanger coil in heat exchange relationship with the refrigerant passing through the tubes. Conventionally, the refrigerant passes in physically counterflow arrangement to the airflow, that is the refrigerant enters the heat exchanger at the air side outlet of the evaportor and passes through the tubes to the refrigerant outlet which is disposed at the air side inlet to the evaporator. The refrigerated air from the evaporator is circulated through a rear flow duct on the backside of the merchandiser housing and thence through a flow duct at the top of the merchandiser housing to exit into the product display area. In open-front display case configurations, the refrigerated air exiting the upper flow duct passes generally downwardly across the front of the product display area to form an air curtain separating the product display area from the ambient environment of the store, thereby reducing infiltration of ambient air into the product display area. Perforations may also be provided in the inner wall of the rear flow duct to permit refrigerated air to pass from the rear flow duct directly into the product display area.

As previously noted, it has been conventional practice in the commercial refrigeration industry to use only heat exchangers of low fin density in evaporators for medium temperature applications. This practice arises in anticipation of the buildup of frost of the surface of the evaporator heat exchanger and the desire to extend the period between required defrosting operations. As frost builds up, the effective flow space for air to pass between neighboring fins becomes progressively less and less until, in the extreme, the space is bridged with frost. As a consequence of frost buildup, heat exchanger performance decreases and the flow of adequately refrigerated air to the product display area decreases, thus necessitating activation of the defrost cycle. Additionally, since the pressure drop through a low fin density evaporator coil is relatively low, such a low pressure drop in combination with a relatively wide spacing between fans as mentioned hereinbefore, results in a significant variance in air velocity through the evaporator coil which in turn results in an undesirable variance, over the length of the evaporator coil, in the temperature of the air leaving the coil. Temperature variances of as high as 6° F. over a span as small as eight inches, are not atypical. Such stratification in refrigeration air temperature can potentially have a large effect on product temperature resulting in undesirable variation in product temperature within the product display area.

When frost forms on the evaporator coil, it tends to accumulate in areas where there is low airflow velocity to begin with. As a result, airflow is further maldistributed and temperature distribution becomes more distorted. Air flow distribution through the evaporator is also distorted as a result of the inherent air flow velocity profile produced by a plurality of conventionally spaced axial flow fans. As each fan produces a bell-curve like velocity flow, the air flow velocity profile is characteristically a wave pattern, with air flow velocity peaking near the centerline of each fan and dipping to a minimum between neighboring fans.

U.S. Pat. No. 5,743,098, Behr, discloses a refrigerated food merchandiser having a modular air cooling and circulating means comprising a plurality of modular evaporators of a predetermined length, each evaporator having a separate air moving means associated therewith. The evaporators are arranged in horizontal, spaced, end-to-end disposition in a compartment beneath the product display area of the merchandiser. A separate pair of axial flow fans is associated with each evaporator for circulating air from an associated zone of the product display zone through the evaporator coil for cooling, and thence back to the associated zone of the product display area. Each evaporator comprises a plurality of fins and tube coils.

SUMMARY OF THE INVENTION

It is an object of this invention to provide an improved medium temperature merchandiser having an improved evaporator performance.

A refrigerated merchandiser is provided having an insulated cabinet defining a product display area and a compartment separate from the product display area wherein an evaporator and at least one air circulating axial flow fan is disposed. The evaporator comprises a first fin and tube heat exchanger coil having a refrigerant inlet and a refrigerant outlet, and a second fin and tube heat exchanger coil having a refrigerant inlet and a refrigerant outlet, the inlet of the second fin and tube heat exchanger coil connected in refrigerant flow communication with the outlet of the first fin and tube heat exchanger coil. The first fin and tube heat exchanger coil has a first fin density and the second fin and tube heat exchanger coil has s second fin density that is greater than the first fin density. Advantageously, first fin and tube heat exchanger coil has a fin density of less than 6 fins per inch and the second fin and tube heat exchanger coil has a fin density of at least 6 fins per inch, and most advantageously, a fin density in the range of 6 fins per inch to 15 fins per inch.

In a method aspect of the present invention, the refrigerated merchandiser is operated to maintain the second heat exchanger coil of the evaporator at a temperature greater than 32 degrees F. whereby a portion of the moisture in the air entering the evaporator from the product display area of the refrigerated merchandiser condenses out of the air onto the heat transfer surface of the second heat exchanger coil.

DESCRIPTION OF THE DRAWINGS

For a further understanding of the present invention, reference should be made to the following detailed description of a preferred embodiment of the invention taken in conjunction with the accompanying drawings wherein.

DESCRIPTION OF THE PREFERRED EMBODIMENT

Figure 1:
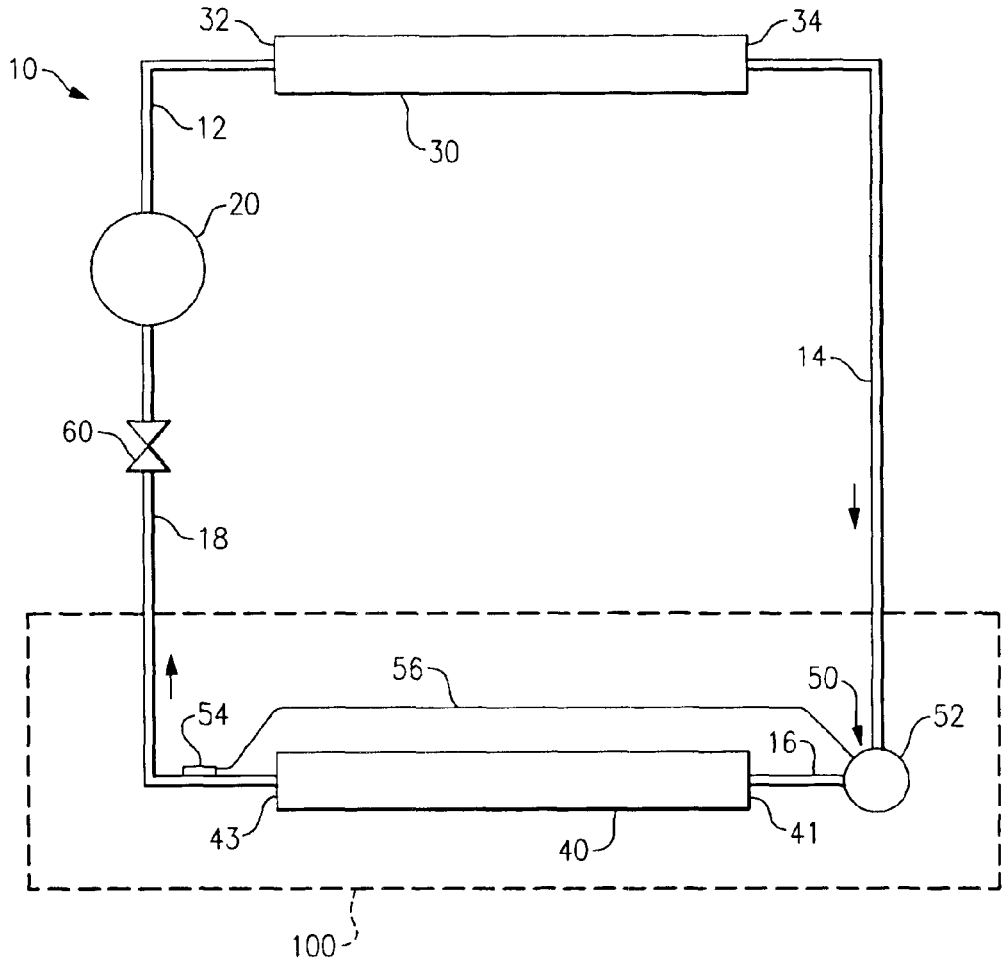
FIG. 1 is a schematic diagram of a commercial refrigeration system having a medium temperature food merchandiser.
Figure 2:
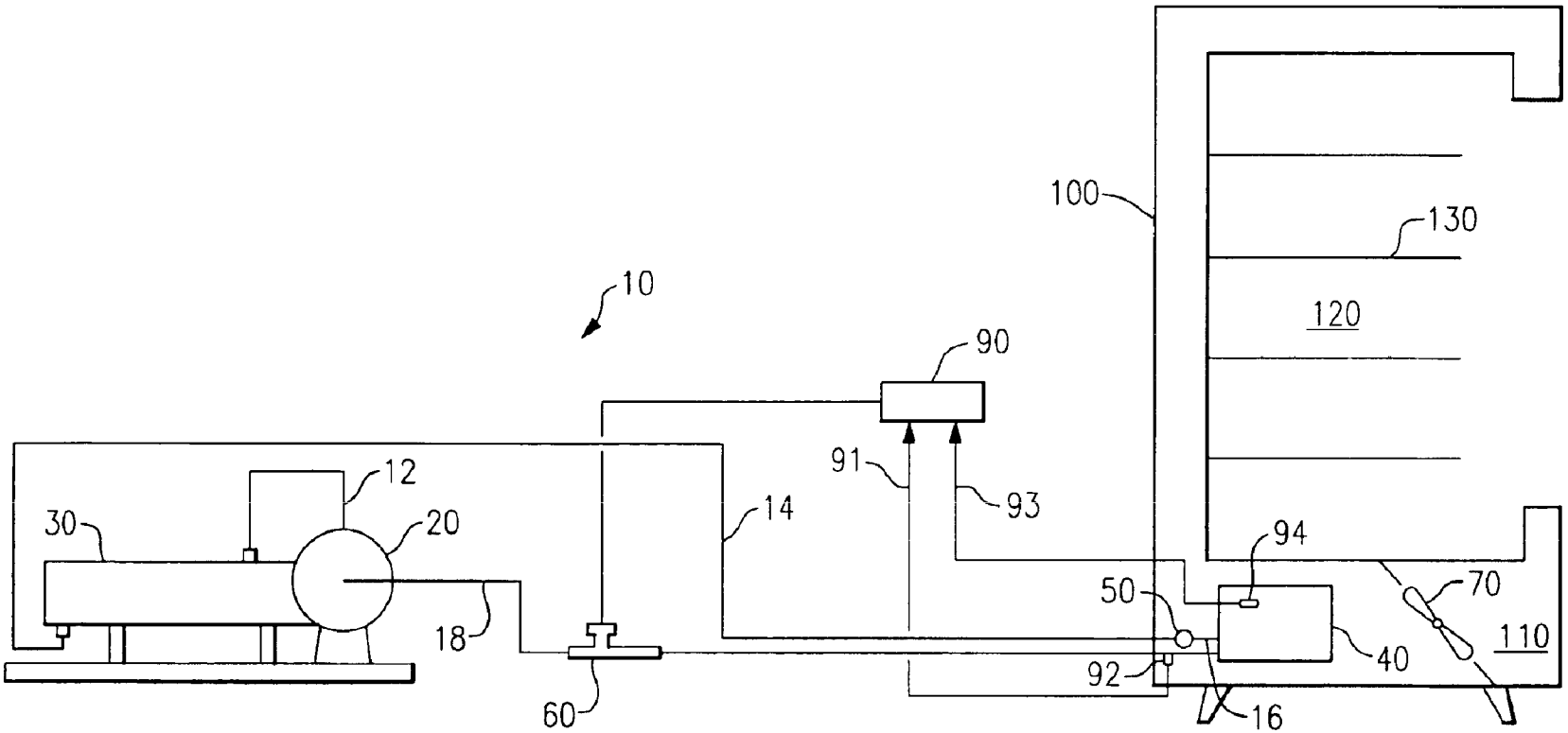
FIG. 2 is an elevation view of a representative layout of the commercial refrigeration system shown schematically in FIG. 1.

The refrigeration system is illustrated in FIGS. 1 and 2 is depicted as having a single evaporator associated with a refrigerated merchandiser, a single condenser, and a single compressor. It is to be understood that the refrigerated merchandiser of the present invention may be used in various embodiments of commercial refrigeration systems having single or multiple merchandisers, with one or more evaporators per merchandiser, single or multiple condensers and/or single or multiple compressor arrangements.

Referring now to FIGS. 1 and 2, the refrigerated merchandiser system 10 includes five basic components: a compressor 20, a condenser 30, an evaporator 40 associated with a refrigerated merchandiser 100, an expansion device 50 and an evaporator pressure control device 60 connected in a closed refrigerant circuit via refrigerant lines 12, 14, 16 and 18. Additionally, the system 10 includes a controller 90. It is to be understood, however, that the refrigeration system may include additional components, controls and accessories. The outlet or high pressure side of the compressor 20 connects via refrigerant line 12 to the inlet 32 of the condenser 30. The outlet 34 of the condenser 30 connects via refrigerant line 14 to the inlet of the expansion device 50. The outlet of the expansion device 50 connects via refrigerant line 16 to the inlet 41 of the evaporator 40 disposed within the display case 100. The outlet 43 of the evaporator 40 connects via refrigerant line 18, commonly referred to as the suction line, back to the suction or low pressure side of the compressor 20.

The refrigerated merchandiser 100, commonly referred to as a display case, includes an upright, open-front, insulated cabinet 110 defining a product display area 125. The evaporator 40, which is a fin and tube heat exchanger coil, is disposed within the refrigerated merchandiser 100 in a compartment 120 separate from and, in the depicted embodiment, beneath the product display area 125. The compartment 120 may, however, be disposed above or behind the product display area as desired. As in convention practice, air is circulated by air circulation means, for example one or more fans 70, disposed in the compartment 120, through the air flow passages 112, 114 and 116 formed in the walls of the cabinet 110 into the product display area 125 to maintain products stored on the shelves 130 in the product display area 125 at a desired temperature. A portion of the refrigerated air passes out the airflow passage 116 generally downwardly across the front of the display area 125 thereby forming an air curtain between the refrigerated product display area 125 and the ambient temperature in the region of the store near the display case 100.

The expansion device 50, which is generally located within the display case 100 close to the evaporator 40, but may be mounted at any location in the refrigerant line 14, serves to meter the correct amount of liquid refrigerant flow into the evaporator 40. As in conventional practice, the evaporator 40 functions most efficiently when as full of liquid refrigerant as possible without passing liquid refrigerant out of the evaporator into suction line 18. Although any particular form of conventional expansion device may be used, the expansion device 50 most advantageously comprises a thermostatic expansion valve (TXV) 52 having a thermal sensing element, such as a sensing bulb 54 mounted in thermal contact with suction line 18 downstream of the outlet 44 of the evaporator 40. The sensing bulb 54 connects back to the thermostatic expansion valve 52 through a conventional capillary line 56.

The evaporator pressure control device 60, which may comprise a stepper motor controlled suction pressure regulator or any conventional evaporator pressure regulator valve (collectively EPRV), operates to maintain the pressure in the evaporator at a preselected desired operating pressure by modulating the flow of refrigerant leaving the evaporator through the suction line 18. By maintaining the operating pressure in the evaporator at that desired pressure, the temperature of the refrigerant expanding from a liquid to a vapor within the evaporator 40 will be maintained at a specific temperature associated with the particular refrigerant passing through the evaporator.

Figure 3:
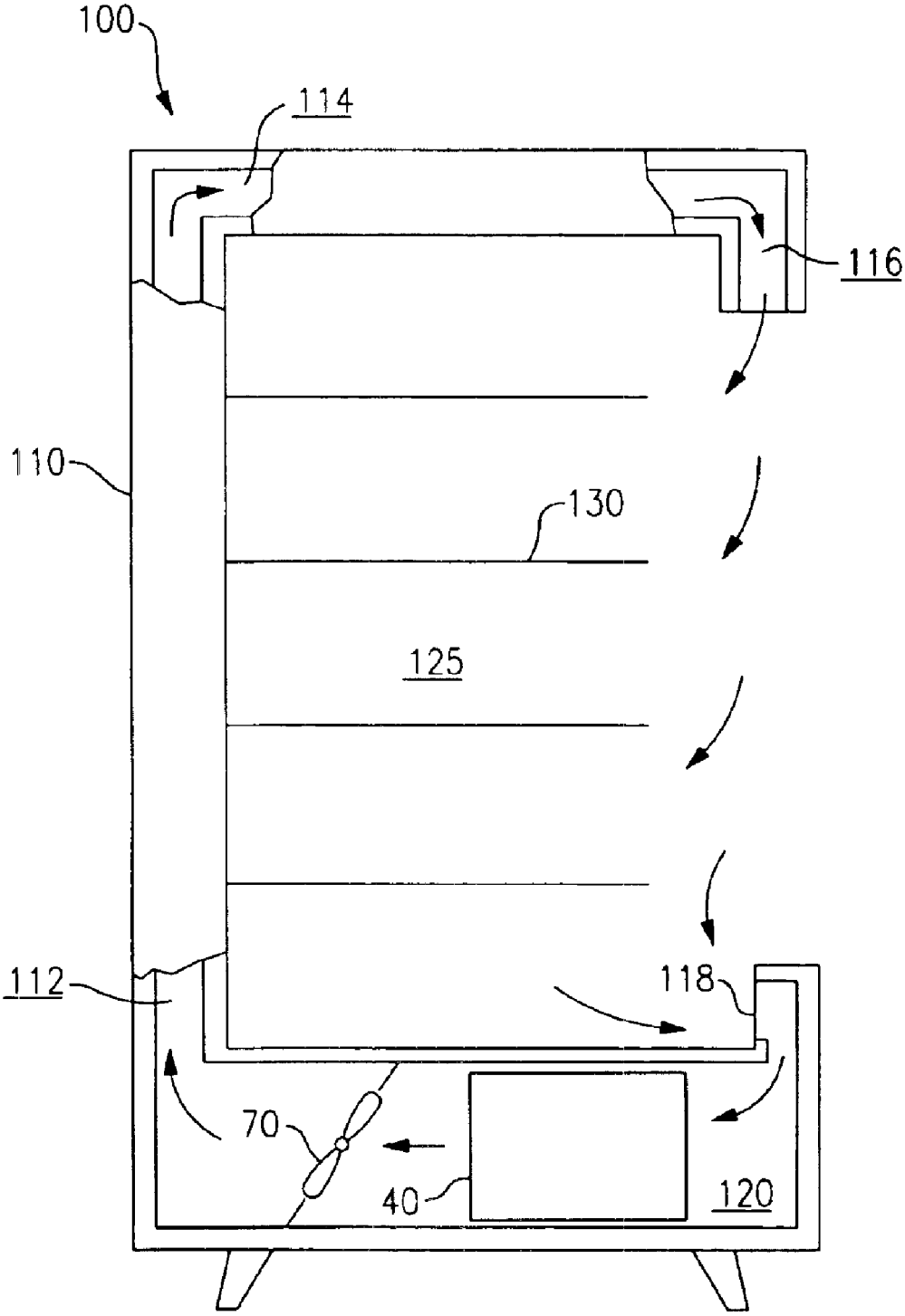
FIG. 3 is a side elevation view, partly in section, of a preferred embodiment of the refrigerated merchandiser of the present invention.

Referring now to FIG. 3, the open-front, insulated cabinet 110 of the refrigerated merchandiser 100 defines a product display area 125 provided with a plurality of display selves 130. The evaporator 40 and one or more air circulating means, for example axial flow fans, 70 are arranged in cooperative relationship in the compartment 120 of the merchandiser 100, which is connected in an air flow circulation circuit with the product display area via flow ducts 112, 114 and 116 provided in the walls of the insulated cabinet 110.

Figure 4:
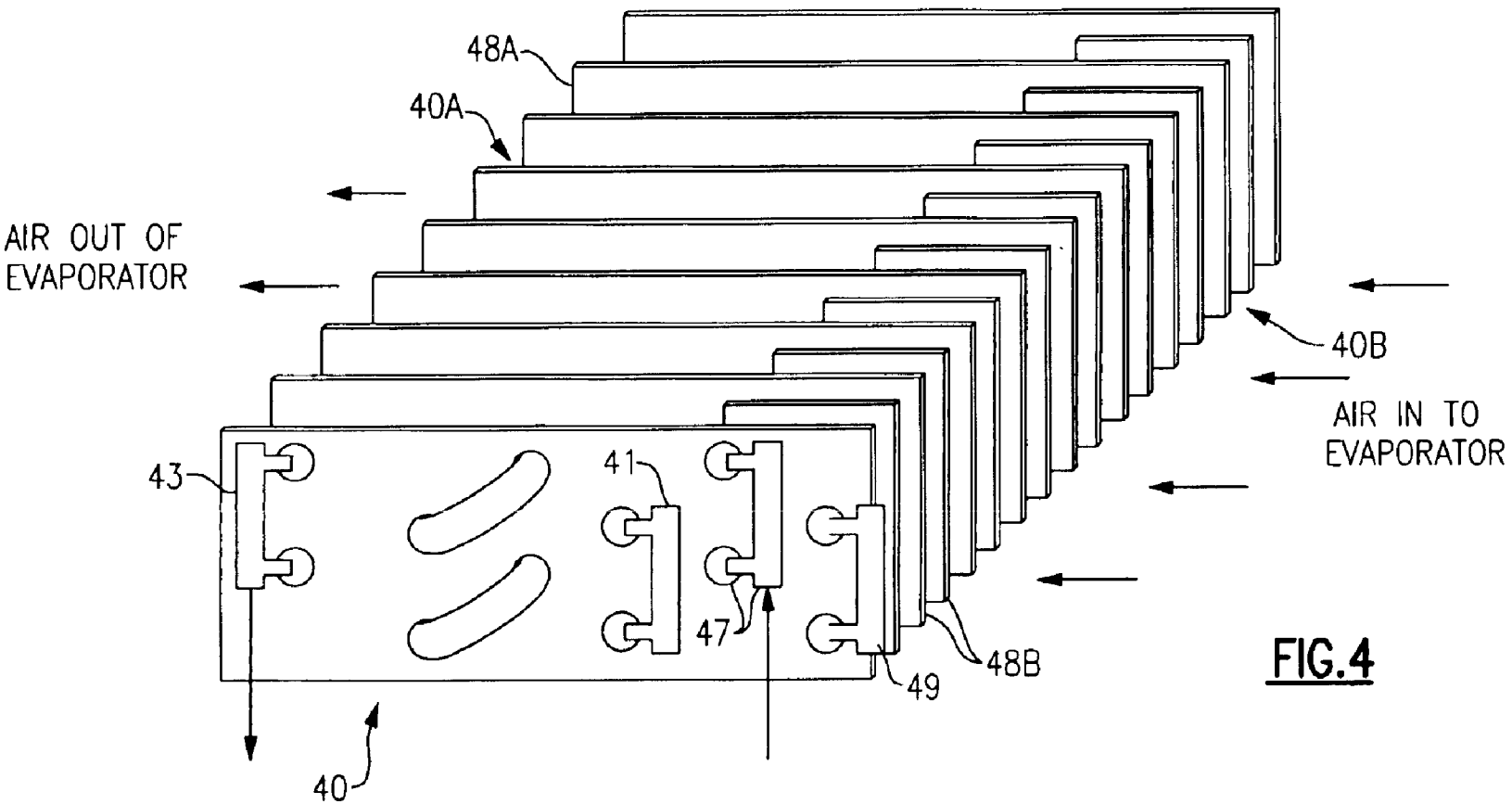
FIG. 4 is a perspective view of an illustrative embodiment of the evaporator of the present invention.
Figure 5:
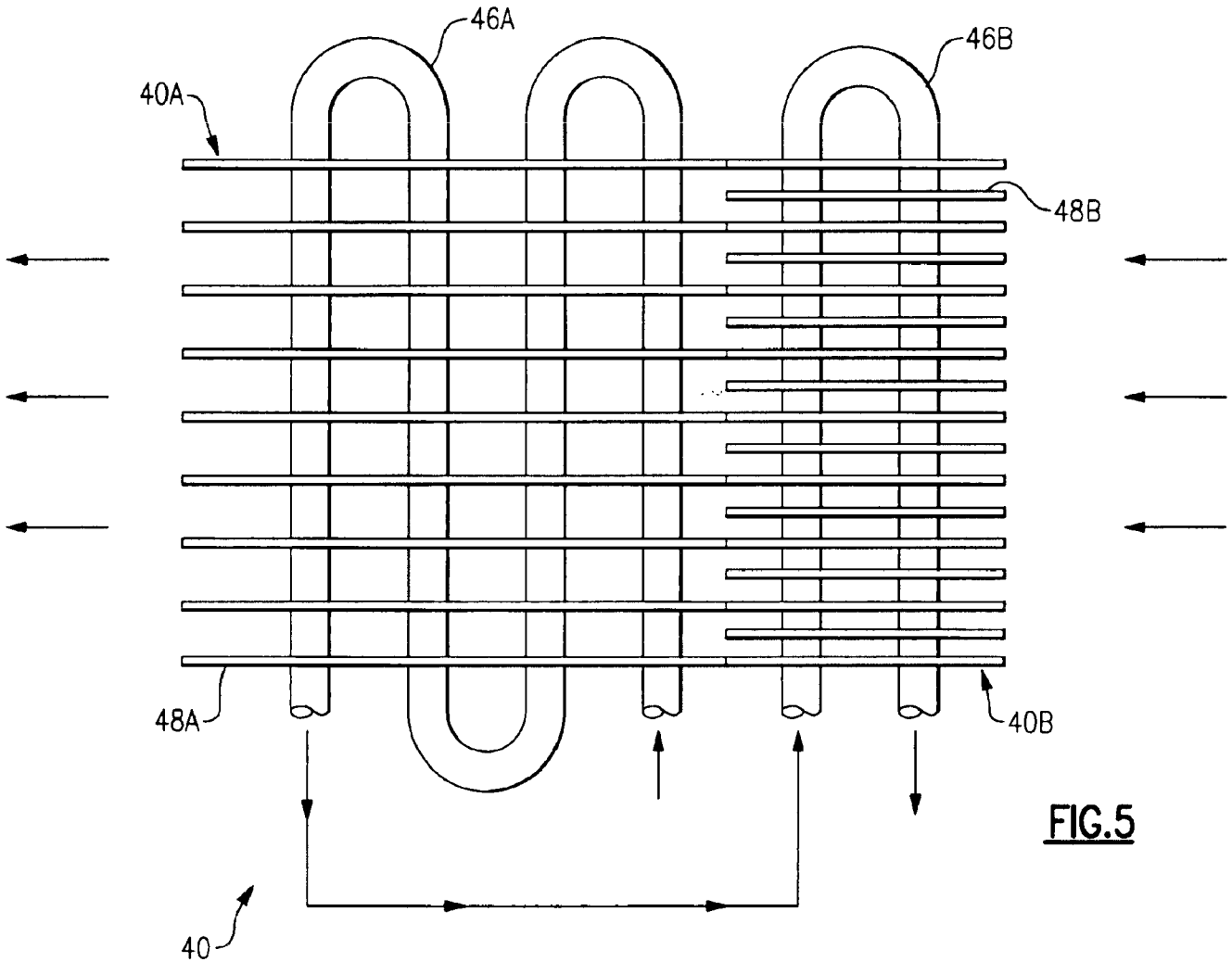
FIG. 5 is a plan view of the evaporator of FIG. 3 taken along line 4—4 of FIG. 3.
Figure 6:
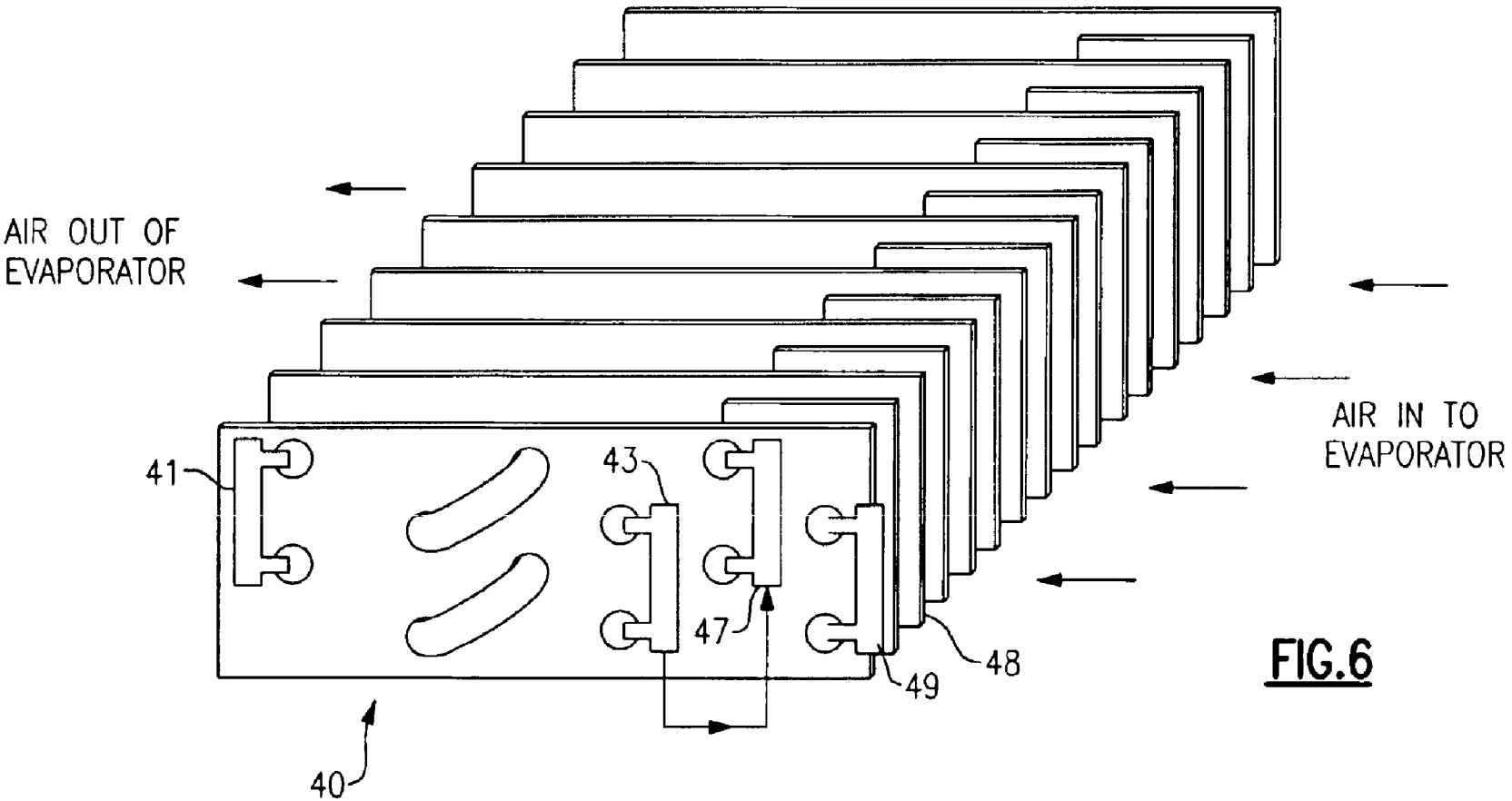
FIG. 6 is a perspective view of an alternate embodiment of the evaporator of the present invention.

Referring now to FIGS. 4, 5 and 6, the evaporator 40 comprises a first fin and tube heat exchanger coil 40A and a second fin and tube heat exchanger coil 40B, each of the type having a plurality of fins mounted on a plurality of serpentine tube coils. The first fin and tube heat exchanger coil 40A has a plurality of fins 48A forming a fin pack comprising a plurality plates disposed in parallel spaced relationship and generally axially aligned with respect to air flow through the evaporator 40A. The second fin and tube heat exchanger coil 40B has a plurality of fins 48B forming a fin pack comprising a plurality plates disposed in parallel spaced relationship and generally axially aligned with respect to air flow through the evaporator 40B. The fins 48A and 48B may be flat plates, corrugated plates, or of any other enhanced heat exchange configuration, as desired. Each tube coil 46A and 46B snakes through its respective fin pack of parallel fins in a conventional manner such that each tube coil forms a plurality of connected tube rows extending transversely through the fin pack. Although each heat exchanger coil is shown as having only two tube coils, it is to be understood that each heat exchange coil may have any number of tube coils as desired. Circulating air flows under the influence of the circulating fans 70 from the product display area through the evaporator 40 to be cooled as in conventional practice. In FIGS. 4, 5 and 6, the direction of air flow through the evaporator is from the right to the left. Ergo, the relatively warm air flow returning from the product display area to be cooled passes first through the second heat exchanger coil 40B and thence through the first heat exchanger coil 40A.

Refrigerant from the refrigeration system passes through lines 14, 16 and enters the first heat exchanger coil 40A of the evaporator 40 through the refrigerant inlet header 41, thence flows through the coils 46A to the refrigerant outlet header 43. From the refrigerant outlet header 43, the refrigerant flows to the refrigerant inlet header 47 of the second heat exchanger coil 40B, thence through the coils 46B to the refrigerant outlet header 49. From the refrigerant outlet header 49, the refrigerant returns through line 18 to the refrigeration system.

For the embodiment of the evaporator 40 illustrated in FIG. 4, in the first heat exchanger coil 40A, the refrigerant flows from the refrigerant inlet header 41 into the upstream most tube rows with respect to air flow through the first heat exchanger coil, through the tubes 46A, to pass out of the tubes 46A into the refrigerant outlet header 43 through the downstream most tube rows with respect to air flow through the first heat exchanger coil. For the embodiment of the evaporator 40 illustrated in FIG. 6, in the first heat exchanger coil 40A, the refrigerant flows from the refrigerant inlet header 41 into the downstream most tube rows with respect to air flow through the first heat exchanger coil 40A, through the coils 46A, to pass out of the tubes 46A into the refrigerant outlet header 43 through the upstream most rows with respect to air flow through the first heat exchanger coil.

In either embodiment, the refrigerant leaving the first heat exchanger coil 40A passes from the refrigerant outlet header 43 of the first heat exchanger coil 40A to the refrigerant inlet header 47 of the second heat exchanger coil 40B. From the refrigerant inlet header 47, the refrigerant into the downstream most tube rows with respect to air flow through the second heat exchanger coil 40B to exit through the upstream most tube rows with respect to air flow through the second heat exchanger coil 40B to the refrigerant outlet header 49 or the second heat exchanger coil 40B. In this manner, the refrigerant flowing through the evaporator 40 is its warmest as it exits the second heat exchanger coil 40B and the circulating air passing through the evaporator 40 is also its warmest as it enters the second heat exchanger coil 40B.

Thus, both the refrigerant and the air are at their highest respective temperatures at the upstream of the evaporator 40, that is in the second heat exchanger coil 40B. Therefore, the surfaces of the second heat exchanger coil 40B are warmer than the surfaces of the first heat exchanger coil 40A. Consequently, the heat transfer surfaces of the fins and tubes of the second heat exchanger coil 40B may advantageously be maintain at a temperature greater than 32 degrees F. By maintaining the surface temperature of the fins and tubes of the second heat exchanger coil 40B above 32 degrees F., moisture in the warmer circulating air from the product display area passing into the evaporator 40 will condense on the surfaces of the second heat exchanger coil and may be drained therefrom in a conventional manner. With at least some of the moisture so removed from the circulating air as it passes through the second heat exchanger coil 40B, the amount of frost formation on the colder heat transfer surfaces of the first heat transfer coil 40A will be reduced.

Figure 7:
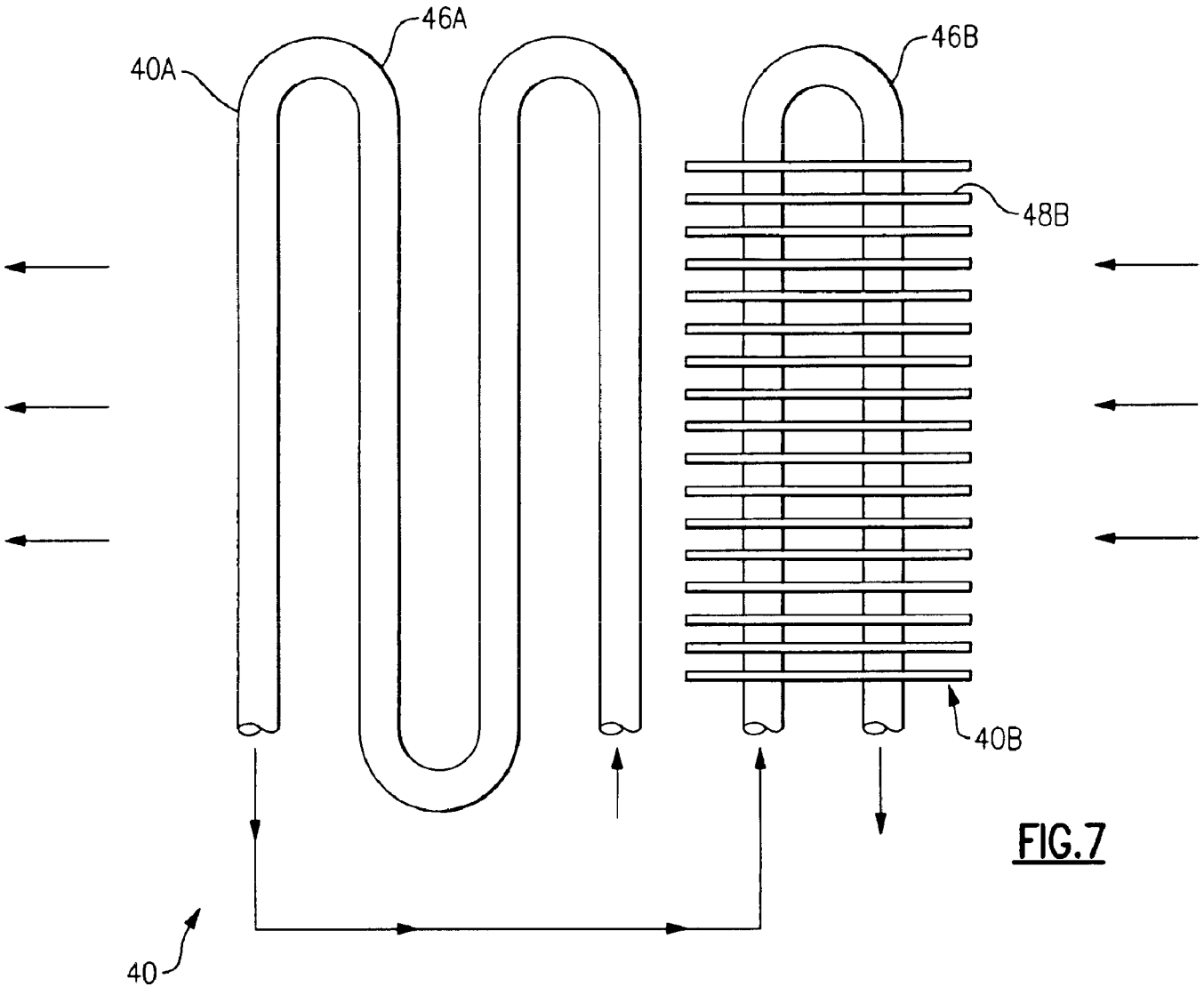
FIG. 7 is a plan view of an alternative embodiment of the evaporator of the present invention.

As the heat transfer surface of the second heat exchanger coil 40B is advantageously maintained at a temperature above the freezing point of water, frost formation will not be a problem in the second bear exchanger coil 30B. Accordingly, the second heat exchanger coil 40B may have a relatively high fin density, that is a fin density of at least 6 fins per inch, to improve and/or optimize heat transfer between the refrigerant and the circulating air. As frost is likely to occur on the colder heat transfer surfaces of the first heat exchanger coil 40A, the first heat exchanger coil will have a relatively low fin density, that is a fin density of less than 6 fins per inch. The first heat exchanger coil 40A may even be a non-finned, bare tube coil, which would have a fin density of zero, as illustrated in FIG. 7. Having a low fin density, frost may accumulate to a greater extent without significant degradation in evaporator performance.

Advantageously, the second heat exchanger coil 40B of the evaporator 40 comprises a relatively high pressure drop fin and tube heat exchanger having a relatively high fin density in the range of six to twenty-five fins per inch and, more advantageously in the range of six to fifteen fins per inch. The relatively high fin density heat exchanger is capable of operating at a significantly lower differential of refrigerant temperature to air temperature than the differential at which conventional low fin density evaporators operate.

As each particular refrigerant has its own characteristic temperature-pressure curve, it is theoretically possible to provide for frost-free operation of the second heat exchanger coil 40B of the evaporator 40 by through controller 90 regulating the set point of the EPRV 60 at a predetermined minimum pressure set point for the particular refrigerant in use. In this manner, the refrigerant temperature within the second heat exchanger coil 40B may be effectively maintained at a point at which all external heat transfer surfaces of the second heat exchanger coil 40B in contact with the moist air within the refrigerated space are above the frost formation temperature. For example, maintaining the temperature of the heat transfer surfaces of the second heat exchanger coil 40B above the freezing point of water could be achieved by maintaining the following conditions: coil saturation temperature from 24 F to 31 F, air entering temperature from 35 F to 45 F, the amount of superheat gain in the second heat exchanger coil from 2 F to 15 F, and pressure drop in the coil at less than about 5 psi.

The controller 90 receives an input signal from at least one sensor operatively associated with the evaporator 40 to sense an operating parameter of the evaporator 40 indicative of the temperature at which the refrigerant is boiling within the evaporator 40. The sensor may comprise a pressure transducer 92 mounted on suction line 18 near the outlet 43 of the evaporator 40 and operative to sense the evaporator outlet pressure. The signal 91 from the pressure transducer 92 is indicative of the operating pressure of the refrigerant within the evaporator 40 and therefore, for the given refrigerant being used, is indicative of the temperature at which the refrigerant is boiling within the evaporator 40. Alternatively, the sensor may comprise a temperature sensor 94 mounted on the coil of the evaporator 40 and operative to sense the operating temperature of the outside surface of the evaporator coil. The signal 93 from the temperature sensor 94 is indicative of the operating temperature of the outside surface of the evaporator coil and therefore is also indicative of the temperature at which the refrigerant is boiling within the evaporator 40. Advantageously, both a pressure transducer 92 and a temperature sensor 94 may be installed with input signals being received by the controller 90 from both sensors thereby providing safeguard capability in the event that one of the sensors fails in operation.

Although a preferred embodiment of the present invention has been described and illustrated, other changes will occur to those skilled in the art. It is therefore intended that the scope of the present invention is to be limited only by the scope of the appended claims. For example, the first and second heat exchanger coils may be contiguous or spaced apart. Some fins may be common to both the first and second heat exchanger coils. The first and second heat exchangers coils may have different fin design and different tube geometry.

What is claimed is:

1. An evaporator for a refrigerated merchandiser situated allowing air flow passage, the evaporator comprising:

a first fin and tube heat exchanger coil having a refrigerant inlet and a refrigerant outlet, said first fin and tube heat exchanger coil having a first fin density; and a second fin and tube heat exchanger coil having a refrigerant inlet and a refrigerant outlet, said second fin and tube heat exchanger coil having a second fin density, said second fin density being greater than said first fin density, the inlet of said second fin and tube heat exchanger coil connected in refrigerant flow communication with the outlet of said first fin and tube heat exchanger coil, such that air flow into said evaporator initially passes across said second fin and tube heat exchanger coil and subsequently passes across said first fin and tube heat exchanger coil.

2. An evaporator for a refrigerated merchandiser as recited in claim 1 wherein said first fin and tube heat exchanger coil has a fin density of less than 6 fins per inch.

3. An evaporator for a refrigerated merchandiser as recited in claim 1 wherein said second fin and tube heat exchanger coil has a fin density of at least 6 fins per inch.

4. An evaporator for a refrigerated merchandiser comprising:

a first heat exchanger having a refrigerant inlet and a refrigerant outlet, said first heat exchanger being a non-finned tube coil heat exchanger; and a second heat exchanger having a refrigerant inlet and a refrigerant outlet, the inlet of said second fin and tube heat exchanger coil connected in refrigerant flow communication with the outlet of said first heat exchanger, said second heat exchanger being a fin and tube heat exchanger coil having a fin density of at least 6 fins per inch.

5. A refrigerated merchandiser including a cabinet defining a product display area and having a compartment separate from product display area, an air circulation circuit connecting said product display area and said compartment in air flow communication, and an evaporator and an air circulating fan disposed within said compartment in cooperative arrangement whereby air flow passing through said evaporator passes in heat exchange relationship with a refrigerant passing through said evaporator, characterized in that said evaporator comprises:

a first fin and tube heat exchanger coil having a refrigerant inlet and a refrigerant outlet, said first fin and tube heat exchanger coil having a relatively low fin density; and a second fin and tube heat exchanger coil having a refrigerant inlet and a refrigerant outlet, said second fin and tube heat exchanger coil having a relatively high fin density, the inlet of said second fin and tube heat exchanger coil connected in refrigerant flow communication with the outlet of said first fin and tube heat exchanger coil, such that said air flow into said evaporator initially passes across said second fin and tube heat exchanger coil and subsequently passes across said first fin and tube heat exchanger coil.

6. A refrigerated merchandiser as recited in claim 5 wherein said first fin and tube heat exchanger coil has a fin density of less than 6 fins per inch.

7. A refrigerated merchandiser as recited in claim 5 wherein said second fin and tube heat exchanger coil has a fin density of at least 6 fins per inch.

8. A refrigerated merchandiser as recited in claim 5 wherein said second fin and tube heat exchanger coil is disposed upstream of said first fin and tube heat exchanger coil with respect to air flow through said evaporator.

9. A refrigerated merchandiser as recited in claim 5 wherein in said first fin and tube heat exchanger coil the refrigerant is directed in physically parallel and thermodynamically counter flow relationship with the air flow passing therethrough.

10. A refrigerated merchandiser as recited in claim 5 further characterized in that in said second fin and tube heat exchanger coil the refrigerant is directed in physically counter thermodynamically parallel flow relationship with air flow passing therethrough.

11. A refrigerated merchandiser as recited in claim 5 further characterized in that said second fin and tube heat exchanger coil has a fin density in the range of 6 fins per inch to 15 fins per inch.

12. In a refrigerated merchandiser system including a cabinet defining a product display area and having a compartment separate from product display area, and air circulation circuit connecting said product display area and said compartment in air flow communication, a fin and tube heat exchanger coil evaporator and an air circulating fan disposed within said compartment in cooperative arrangement whereby air flow passing through said evaporator passes in heat exchange relationship with a refrigerant passing through said evaporator, and a refrigeration system operatively associated with said evaporator, a method of operation comprising:

passing refrigerant from the refrigeration system through a first section of said evaporator;

passing refrigerant from the first section of said evaporator to through a second section of said evaporator;

passing refrigerant from the second section of said evaporator back to the refrigeration system;

circulating air from the product display area first through the second section of said evaporator thence through the first section of said evaporator and thence back to the product display area of said refrigerated merchandiser; and maintaining the second section of said evaporator at a temperature greater than 32 degrees F.

13. A method of operation as recited in claim 12 further comprising providing the second section of said evaporator with a fin density of at least 6 fins per inch and providing the first section of said evaporator with a fin density of less than 6 fins per inch.

* * * * *